US011253117B2

(12) United States Patent
De Pena

(10) Patent No.: US 11,253,117 B2
(45) Date of Patent: Feb. 22, 2022

(54) TOILET SEAT ATTACHMENT ASSEMBLY AND METHOD OF USE

(71) Applicant: Hector De Pena, Pembroke Pines, FL (US)

(72) Inventor: Hector De Pena, Pembroke Pines, FL (US)

( * ) Notice: Subject to any disclaimer, the term of this patent is extended or adjusted under 35 U.S.C. 154(b) by 0 days.

(21) Appl. No.: 16/841,603

(22) Filed: Apr. 6, 2020

(65) Prior Publication Data

US 2020/0315411 A1 Oct. 8, 2020

Related U.S. Application Data

(60) Provisional application No. 62/829,463, filed on Apr. 4, 2019.

(51) Int. Cl.
*A47K 13/26* (2006.01)
*A47K 13/12* (2006.01)

(52) U.S. Cl.
CPC ..... *A47K 13/26* (2013.01); *A47K 13/12* (2013.01)

(58) Field of Classification Search
CPC ..... A47K 13/26; A47K 13/12
USPC ..... 4/240, 420
See application file for complete search history.

(56) References Cited

U.S. PATENT DOCUMENTS 3,646,620 A 3/1972 McCawley
4,639,147 A * 1/1987 Schwarz ..... A47K 13/12 114/144 R
4,747,167 A 5/1988 Adams
5,212,840 A 5/1993 Caldwell
5,361,425 A 11/1994 Armanno, Sr.
6,381,762 B1 * 5/2002 Moser ..... A47K 13/12 16/252
6,763,529 B1 * 7/2004 Richter ..... A47K 13/26 4/236
7,490,366 B1 * 2/2009 Richter ..... A47K 13/26 4/236
7,536,732 B1 5/2009 Dunlap
8,091,152 B1 1/2012 Rucker et al.
2006/0107450 A1 5/2006 Gildersleeve
2010/0017947 A1 1/2010 Hobbs
2013/0291295 A1 11/2013 Falzarano

FOREIGN PATENT DOCUMENTS

GB 2443629 A 5/2008

* cited by examiner

*Primary Examiner* — Christine J Skubinna
(74) *Attorney, Agent, or Firm* — Mark C. Johnson; Johnson Dalal

(57) ABSTRACT

Two polymeric, cylindrical, and tubular bushings that each have an inner surface defining inner diameter, an outer surface defining an outer diameter, an upper end, a lower end opposing the upper end of the bushing, a bushing length separating the upper and lower ends of the bushing, and a bushing channel defined by the inner surface of the bushing and spanning the bushing length, disposed, respectively, within bowl bores defined by a toilet bowl, and with a threaded screw, coupled to a toilet seat, disposed within the bushing channel and coupled to the inner surface of the bushing, wherein the bushings prevent inadvertent loosening of the toilet seat when attached to the toilet bowl.

15 Claims, 6 Drawing Sheets

3-3

3-3

TOILET SEAT ATTACHMENT ASSEMBLY AND METHOD OF USE

CROSS-REFERENCE TO RELATED APPLICATION

This application claims priority to U.S. Provisional Patent Application No. 62/829,463, filed Apr. 4, 2019, the entirety of which is hereby incorporated by reference.

FIELD OF THE INVENTION

The present invention relates generally to toilet seats, and, more particularly, relates to systems and methods directed toward coupling a toilet seat to a toilet bowl.

BACKGROUND OF THE INVENTION

Most individuals own and/or use toilets having a bowl and seat selectively, removably, and rotatably coupled thereto. Most toilet bowls and seats are of a standard or uniform size. Traditional installation or removal of a toilet seat includes selecting a toilet seat, which usually comes in two basic styles, i.e., a rounded seat or an elongated seat. Toilet seats may also include a spring and/or dampening mechanism to prevent it from slamming down on a top surface or rim of a bowl. First a user may remove one or more plastic caps covering a hinge coupling the toilet seat to the toilet bowl and/or threaded bolts, screws, or other fastener (generally referred to herein as "screw" or "bolt." To remove a seat, the user will loosen one or more nuts selectively removably coupled to the bolt extending through the porcelain body of the toilet bowl. Some known assemblies utilize annular washers between the nut and the toilet bowl, which will be removed as well. After the nut and/or washer has been removed, the toilet seat can generally be removed from the toilet bowl by lifting the toilet seat.

Next, a user can insert the bolt(s) from a new toilet seat and insert them into the aperture(s) and bore(s) defined by the toilet bowl. Since the new toilet seat is placed exactly where the previous seat was, the aperture(s) and bore(s) and screws should be aligned and sized correct. Typical aperture (s) and bore(s) will be designed to tightly or snugly receive the bolt(s) from the new toilet seat, wherein a head of the bolt(s) will prevent the bolt from extending completely through the aperture(s) and bore(s) defined by the toilet bowl. In other embodiments, washer(s) may be utilized to size and seat the toilet seat with the bolt(s). Next, a user will couple a nut and/or washer to an end of a bolt by turning the nut (generally, clockwise) until it is as tight as possible. This is repeated until all bolt(s) secure the toilet seat to the toilet bowl. In some embodiments and versions of toilet seats, a user does not drive the bolts through hinges; rather a user will drop the bolts directly through the aperture(s) and bore(s) on either side of the toilet bowl, instead of driving them through a hinge first. The toilet seat's hinge(s) will snap onto or slide over the bolt heads. An exemplary prior art and known toilet is depicted in FIG. 1.

In all known embodiments, however, repeated use of the toilet seat causes vibration that continually and routinely causes the nut(s) coupled to the bolt(s) to become loose. This problematically results in the toilet seat becoming loose, which many users find problematic. To solve this problem, some known devices make the toilet seat partially unitary with the toilet bowl. This solution, however, prevents a user from changing the toilet seat if needed. Additionally, this solution also produces a higher-priced product.

Therefore, a need exists to overcome the problems with the prior art as discussed above.

SUMMARY OF THE INVENTION

The invention provides a toilet seat attachment assembly and method of use that overcomes the hereinafore-mentioned disadvantages of the heretofore-known devices and methods of this general type and that effectively and efficiently retains the toilet seat to the toilet bowl with minimizing its probability of becoming loose (unless desired by the user).

With the foregoing and other objects in view, there is provided, in accordance with the invention, an improvement in combination with a toilet bowl defining a bowl aperture, two upper bore apertures disposed on a top surface of the toilet bowl, two lower bore apertures disposed on a bottom surface of the toilet bowl, and two bowl bores each spanning, respectively, from the two upper bore apertures to the two lower bore apertures and a toilet seat having two threaded screws coupled to the toilet seat and shaped and sized to be received within the two upper and lower bore apertures and the two bowl bores. The improvement includes two polymeric, cylindrical, and tubular bushings that each have an inner surface defining inner diameter, an outside surface defining an outer diameter, an upper end, a lower end opposing the upper end of the bushings, a bushing length separating the upper and lower ends of the bushing, and a bushing channel defined by the inner surface of the bushing and spanning the bushing length. The bushings are also disposed, respectively, within the bowl bores and have one of the two threaded screws of the toilet disposed within the bushing channel and coupled to the inner surface of the bushing.

In accordance with a further feature of the present invention, the bushing is frictionally retained by the toilet bowl. In another embodiment, the inner diameter of the busing is of a uniformly width along the bushing length and the bushing is of a substantially rigid material.

In accordance with another feature, an embodiment of the present invention also includes the two bowl bores defining a bore length separating the two upper and lower bore apertures and with the bushing length is at least the bore length.

In accordance with yet another feature of the present invention, the bushing length is greater than the bore length.

In accordance with an additional feature, an embodiment of the present invention also includes the two nuts threadedly engaged with the two threaded screws and each with an upper nut surface and an opposing lower surface thereon, the upper surface directly coupled to the bushing in a compression configuration.

In accordance with yet another feature of the present invention, the two nuts are of a polymeric material and include a plurality of flanges disposed thereon. Additionally, the bushing and the two nuts may be of a nylon material.

In accordance with yet another feature of the present invention, the two threaded screws are fixedly and directly coupled to each of the respective bushings.

In accordance with the present invention, the improvement may also include two polymeric and tubular bushings each having an inner surface defining inner diameter, an outside surface defining an outer diameter, an upper end, a lower end opposing the upper end of the bushings, a bushing length separating the upper and lower ends of the bushing, and a bushing channel defined by the inner surface of the bushing and spanning the bushing length. The bushings are disposed, respectively, within the bowl bores and include one of the two threaded screws disposed within the bushing channel and fixedly and directly coupled to the inner surface of the bushing.

In accordance with yet another feature of the present invention, the two bushings each have the one of the two threaded screws fixedly and directly coupled to the inner surface of the bushing the bushing length.

Although the invention is illustrated and described herein as embodied in a toilet seat attachment assembly and method of use, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the toilet seat, spanning from the rear end to the front end of the toilet seat.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
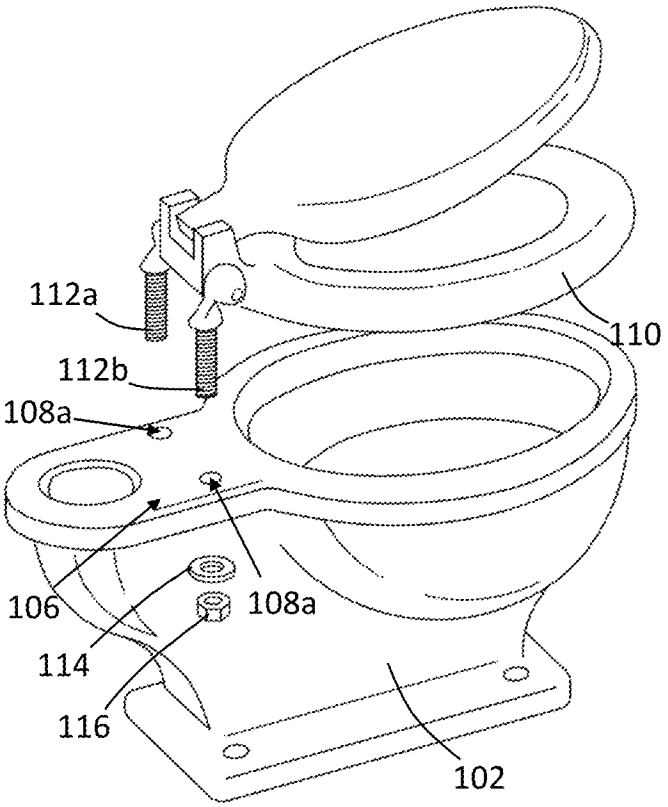
Prior Art FIG. 1
FIG. 1 is an exploded view of a prior art toilet.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 5:
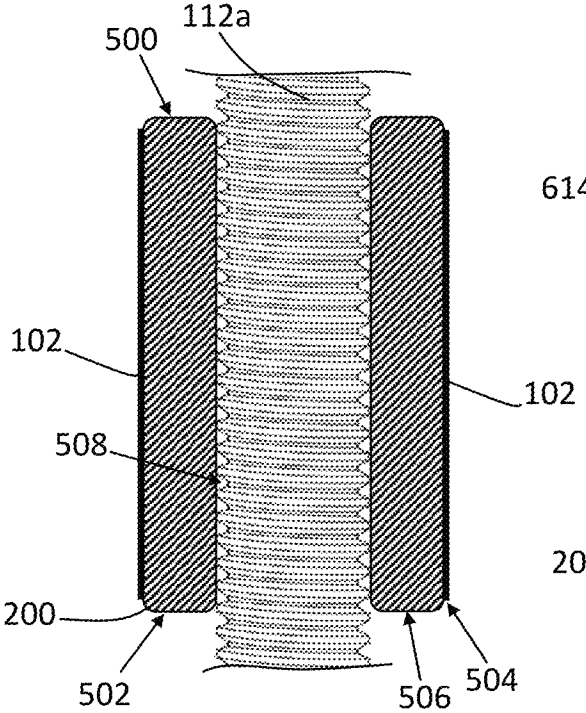
FIG. 5 is a cross-sectional and fragmentary view of a toilet seat attachment assembly in accordance with one embodiment of the present invention.
Figure 8:
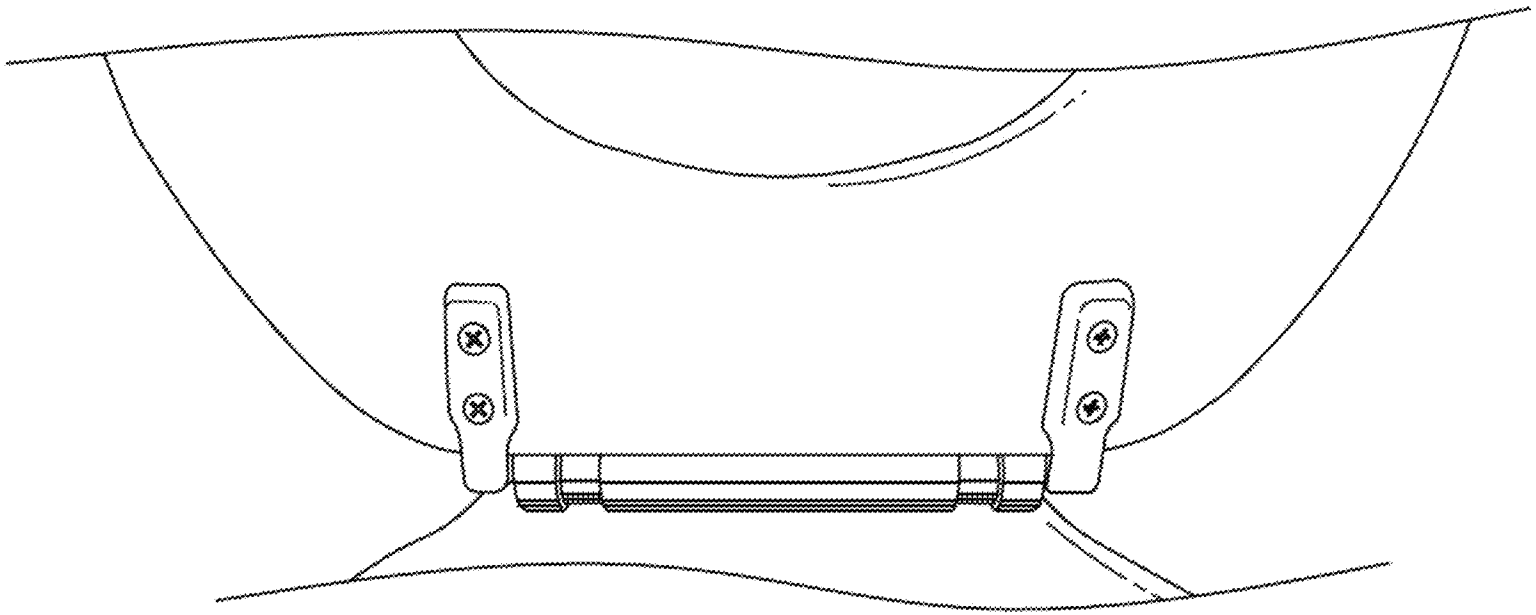
FIG. 8 is a front perspective view of a toilet bowl attachment assembly in accordance with one embodiment of the present invention.

The present invention provides a novel and efficient toilet seat attachment assembly that is utilizing in combination with a known toilet bowl assembly as exemplified in FIG. 1. More specifically, the toilet bowl assembly includes a toilet bowl 102 defining a bowl aperture 104, two upper bore apertures 108*a-b* disposed on a top surface 106 of the toilet bowl 102, two lower bore apertures (one lower bore aperture is depicted in FIG. 5 with numeral 504) disposed on a bottom surface 506 of the toilet bowl 102. As those of skill in the art will appreciate, the two bowl bores each span from one of the upper bore apertures 108*a-b* to one of the lower bore apertures 504. The toilet assembly also includes a toilet seat 110 having two threaded screws 112*a-b* coupled to the toilet seat 110. As discussed above, there may be one or more screws 112*a-b* and said screws 112*a-b* may extend from a hinge of the toilet seat 110, or from the seat 110 itself.

The screws 112*a-b* may be polymeric, metallic, or another material. The screws 112*a-b* are also shaped and sized to be received within the two upper and lower bore apertures 108*a-b*, 504 and the two bowl bores. Typical screws, or threaded fasteners, are of a length of approximately 2-4 inches, but they may span outside of said range.

Beneficially and with reference to FIGS. 1-2 and FIGS. 5-7, a polymeric, cylindrical, and tubular bushing 200 is disposed within each of the bowl bores to minimize and/or dampen vibration caused from the opening and closing of the toilet seat 110 (that conventionally causes the nut to disengage or loosen, along with the toilet seat 110) and to create a mechanical coupling bond between a lower end 502 of the bushing an a nut, e.g., nut 202, rotatably fastened to the threaded fastener 112 of the toilet seat 112. The bushing 200 may include inner surface 612 defining inner diameter 602, an outer surface 614 defining an outer diameter 600, an upper end 500, a lower end 502 opposing the upper end 502 of the bushing 200, a bushing length 610 separating the upper and lower ends 500, 502 of the bushing 200, and a bushing channel 604 defined by the inner surface 612 of the bushing and spanning the bushing length 610. Beneficially, the bushing 200 is disposed within each of the bowl bores and with one of the two threaded screws 112*a-b* disposed within the bushing channel 604 and coupled to the inner surface 612 of the bushing 200.

Figure 7:
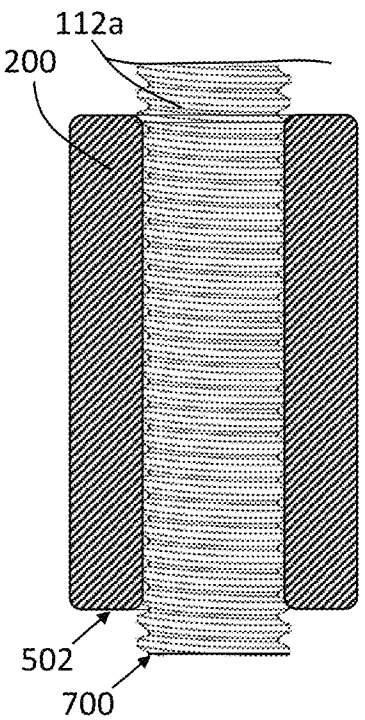
FIG. 7 is a cross-sectional view of a bushing and screw configuration utilized with a toilet seat attachment assembly in accordance with another embodiment of the present invention.
Figure 6:
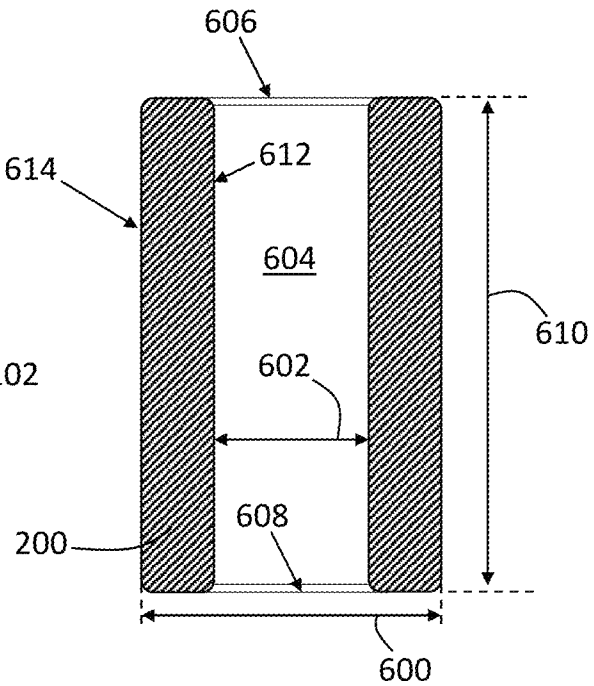
FIG. 6 is a cross-sectional view of a bushing utilized with a toilet seat attachment assembly in accordance with one embodiment of the present invention.

In one advantageous embodiment, the bushings 200 are selectively removably couplable to the toilet bowl 102 and disposed for insertion of one of the two threaded screw 112*a-b* therethrough. As such, the present invention may be retrofit onto conventional toilet seat assemblies. This embodiment is best depicted in FIGS. 5-6. In other embodiments, as best depicted in FIG. 7, the bushings 200 are fixedly and directly coupled to each of the respective two threaded screws 112*a-b*, e.g., through welding, casting, a threaded engagement, etc. Said another way, the bushings 200 and the threaded screws 112*a-b* move as one because they are mechanically affixed together. In one embodiment, the two bushings 200 each have the one of the two threaded screws 112*a-n* fixedly and directly coupled to the inner surface 612 of the bushing 200 along the entire bushing length 610. Said another way, the distal end 700 of the threaded screws 112*a-n* protrudes from the lower end 502 of the bushing 200 a length sufficient to allow attachment of the nut 300 (e.g., approximately 1-2 inches). If the inner surface 612 of the bushing 200 has a mechanical fastener disposed thereon, e.g., tongue-and-groove or threaded configuration, and corresponding to the two threaded screws 112*a-n*, the bushing 200 may still be able to be retrofit with conventional toilet seats 110 and their threaded screws 112*a-n*.

In preferred embodiments, the bushing 200 is frictionally retained by the toilet bowl 102. Said another way, the bushing 200 is specifically shaped and sized to deform slightly in order to be inserted within the upper and lower bore apertures 108*a-b*, 504, and the bore channel. For example, the bushing diameter 600 may be a diameter of approximately 2 inches, and the bore apertures 108*a-b* and two bowl bores may be approximately 1.90 inches, thereby requiring slight non-plastic deformation of the bushing 200 when inserted into the bore apertures 108*a-b* and two bowl bores. The outer surface 614 of the bushing 200 causes compression with the bowl 102 defining the bore apertures 108*a-b* and two bowl bores, keeping it retained therein more effectively.

In order to effectively receive the screw of the toilet seat 112, the inner diameter 602 and/or outer diameter 600 of the bushing 200 may be uniformly configured along the bushing length 610. The two upper and lower bore apertures 108, 504 may also each define a bore length spanning therefrom, wherein the bushing length 610 may be at least the bore length. The bushing length 610 may be greater than or equal to the bore length but is preferably is greater than the bore length in order to form a solid mechanical coupling bond as described above. Said another way, when a nut 202 is rotatably translated along the screw 112 until it reaches a protruding portion of the bushing 200, the continued twisting force causes the snug bushing 200 to flex laterally, thereby causing compression of the outer surface 614 of the bushing against an inner surface of the toilet body 102 defining the bore.

The bushing 200 and/or nut is beneficially of a deformably rigid material such as nylon, having a hardness ranging from approximately 70-110 Shore A. Said another way, the bushing 200 is of a hardness sufficient to enable it to flex or bow when subjected to a tensile force of approximately 2-5 lbf. In other embodiments, the bushing 200 and/or the nut 202 may be a polyurethane such as PTFE or polypropylene. The other figures depicted herein also disclose features and characteristics of the invention, but as described herein and depicted in the figures, the invention can be provided in several shapes, sizes, combinations of features and components, and varying numbers and functions of the components.

Figure 2:
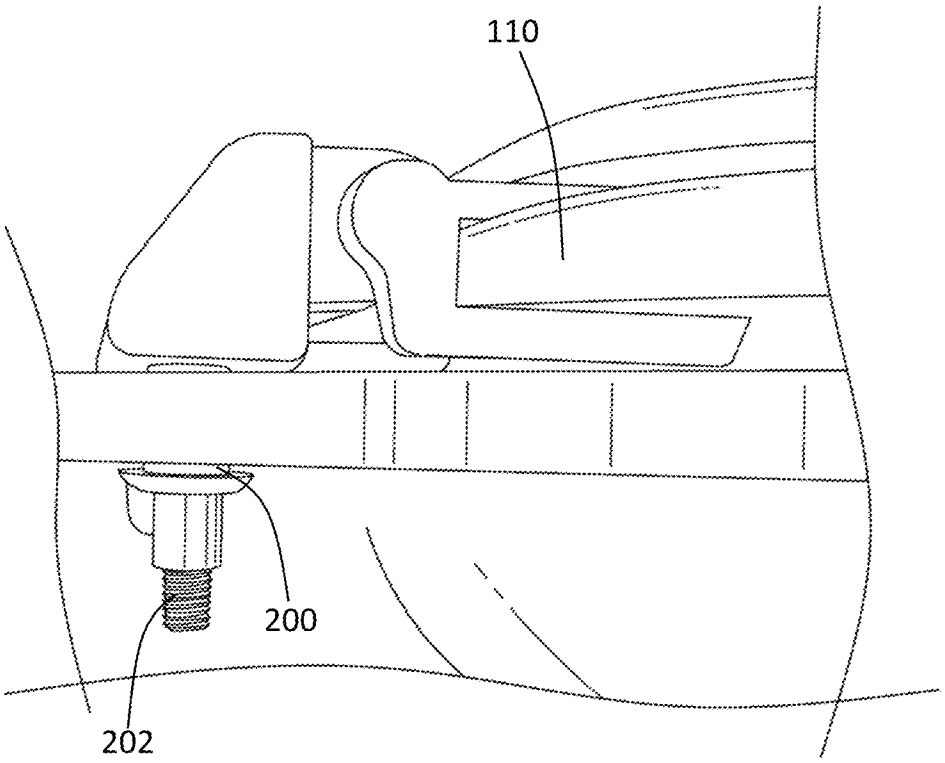
FIG. 2 is a close-up elevational side view of a toilet seat attachment assembly in accordance with the present invention.
Figure 3:
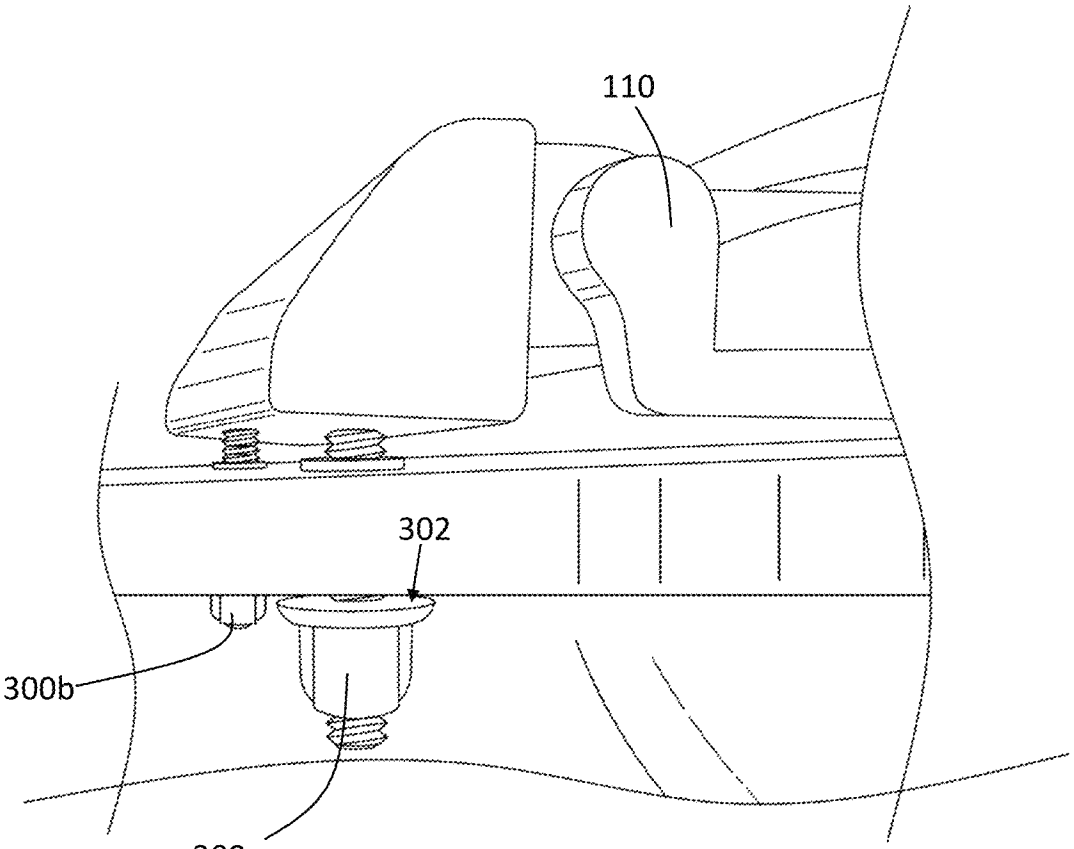
FIG. 3 is a close-up perspective view of a toilet seat attachment assembly in accordance with the present invention.
Figure 4:
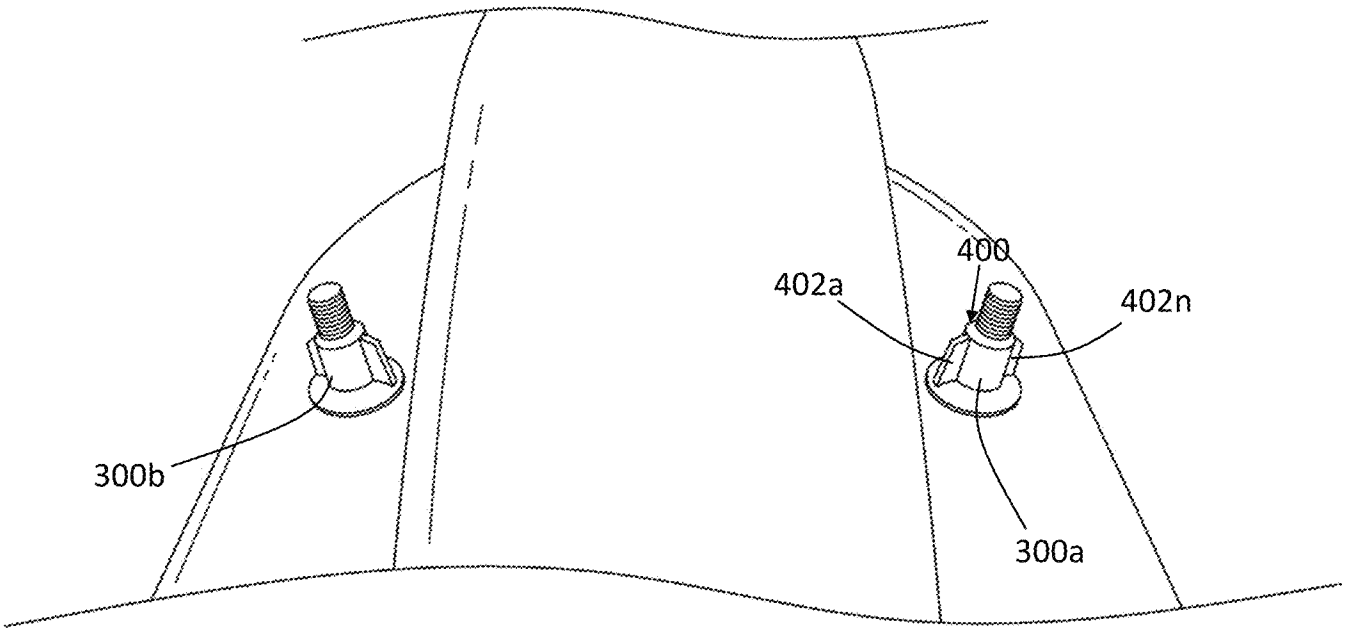
FIG. 4 is a perspective view of a bottom surface of a toilet bowl in accordance with one embodiment of the present invention.

As best seen in FIGS. 2-4, the two nuts 300*a-b* are threadedly engaged with the two threaded screws 112*a-b*. Each of the nuts 300*a-b* have an upper nut surface 302 and an opposing lower surface 400 thereon, wherein the upper surface 302 is operably configured to directly couple to the bushing 200 in a compression configuration (depicted in FIG. 2 and FIG. 4). Said another way, the nuts 300*a-b* enable a mechanically rigid coupling configuration that prevents (or reduces the likelihood of) detachment or loosening of the toilet seat 110 with respect to the toilet bowl 102. Furthermore, the two nuts 300*a-b* may be of a polymeric material and include a plurality of flanges 402*a-n* disposed thereon for easy and effective grasping and rotation by the user with respect to the threaded fasteners 112*a-b*.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. In combination with a toilet bowl defining a bowl aperture, two upper bore apertures disposed on a top surface of the toilet bowl, two lower bore apertures disposed on a bottom surface of the toilet bowl, and two bowl bores each spanning, respectively, from the two upper bore apertures to the two lower bore apertures and a toilet seat having two threaded screws coupled to the toilet seat and shaped and sized to be received within the two upper and lower bore apertures and the two bowl bores, the improvement comprising:

two polymeric, cylindrical, and tubular bushings each:

having an inner surface defining inner diameter, an outside surface defining an outer diameter, an upper end, a lower end opposing the upper end of the bushings, a bushing length separating the upper and lower ends of the bushing, and a bushing channel defined by the inner surface of the bushing and spanning the bushing length;

selectively removably disposed, respectively, within the bowl bores; and with one of the two threaded screws disposed within the bushing channel and uncoupled to the inner surface of the bushing, whereby each of the two threaded screws are freely disposed for insertion therethrough bushing channel; and two nuts threadedly engaged with the two threaded screws and each with an upper nut surface and an opposing lower surface thereon, the upper surface directly coupled to the bushing in a mechanically coupling bond configuration.

2. The improvement according to claim 1, wherein:

the bushing is frictionally retained by the toilet bowl.

3. The improvement according to claim 2, wherein:

the inner diameter of the busing is of a uniformly width along the bushing length.

4. The improvement according to claim 2, wherein:

the bushing is of a substantially rigid material.

5. The improvement according to claim 2, the two bowl bores defining a bore length separating the two upper and lower bore apertures, wherein:

the bushing length is at least the bore length.

6. The improvement according to claim 5, wherein:

the bushing length is greater than the bore length.

7. The improvement according to claim 1, wherein:

two nuts are of a polymeric material and include a plurality of flanges disposed thereon.

8. The improvement according to claim 7, wherein:

the bushing and the two nuts are of a nylon material.

9. In combination with a toilet bowl defining a bowl aperture, two upper bore apertures disposed on a top surface of the toilet bowl, two lower bore apertures disposed on a bottom surface of the toilet bowl, and two bowl bores each spanning, respectively, from the two upper bore apertures to the two lower bore apertures and a toilet seat having two threaded screws coupled to the toilet seat and shaped and sized to be received within the two upper and lower bore apertures and the two bowl bores, the improvement comprising:

two polymeric and tubular bushings each:

having an inner surface defining inner diameter, an outside surface defining an outer diameter, an upper end, a lower end opposing the upper end of the bushings, a bushing length separating the upper and lower ends of the bushing, and a bushing channel defined by the inner surface of the bushing and spanning the bushing length;

selectively removably disposed, respectively, within the bowl bores; and with one of the two threaded screws disposed within the bushing channel and fixedly and uncoupled to the inner surface of the bushing, whereby each of the two threaded screws are freely disposed for insertion therethrough bushing channel; and two nuts threadedly engaged with the two threaded screws and each with an upper nut surface and an opposing lower surface thereon, the upper surface directly coupled to the bushing in a mechanically coupling bond configuration.

10. The improvement according to claim 9, wherein:

the two bushings are each cylindrical.

11. The improvement according to claim 9, wherein:

the bushing is frictionally retained by the toilet bowl.

12. The improvement according to claim 11, wherein:

the inner diameter of the busing is of a uniformly width along the bushing length.

13. The improvement according to claim 12, wherein:

the bushing is of a substantially rigid material.

14. The improvement according to claim 13, the two bowl bores defining a bore length separating the two upper and lower bore apertures, wherein:

the bushing length is at least the bore length.

15. The improvement according to claim 14, wherein:

the bushing length is greater than the bore length.

* * * * *